US007841679B2

(12) United States Patent
Usui

(10) Patent No.: US 7,841,679 B2
(45) Date of Patent: Nov. 30, 2010

(54) LIQUID EJECTION APPARATUS AND LIQUID EJECTION METHOD

(75) Inventor: Toshiki Usui, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 811 days.

(21) Appl. No.: 11/775,586

(22) Filed: Jul. 10, 2007

(65) Prior Publication Data

US 2008/0012889 A1 Jan. 17, 2008

(30) Foreign Application Priority Data

Jul. 13, 2006 (JP) ..... 2006-193178

(51) Int. Cl.
*B41J 29/38* (2006.01)

(52) U.S. Cl. ..... 347/11; 347/10

(58) Field of Classification Search ..... 347/5, 347/9–11

See application file for complete search history.

(56) References Cited

U.S. PATENT DOCUMENTS 6,231,150 B1 * 5/2001 Ito ..... 347/11
6,257,689 B1 * 7/2001 Yonekubo ..... 347/11
6,619,777 B2 * 9/2003 Chang ..... 347/10
7,441,853 B2 10/2008 Takata

FOREIGN PATENT DOCUMENTS

JP 2000-52570 A 2/2000
JP 2002-240300 A 8/2002
JP 2006-088695 A 4/2006

* cited by examiner

*Primary Examiner*—Lamson D Nguyen
(74) *Attorney, Agent, or Firm*—Sughrue Mion, PLLC

(57) ABSTRACT

The invention achieves efficient use of generation circuits of drive signals COM. The invention provides a liquid ejection method that includes:

causing a certain drive signal generation unit to generate a first drive signal and a second drive signal;

causing another drive signal generation unit to generate a first drive signal and a second drive signal;

supplying the first drive signal generated by the certain drive signal generation unit and the second drive signal generated by the other drive signal generation unit to a certain head unit, the certain head unit being one of a plurality of head units arranged in an intersecting direction that intersects a transport direction of a medium; and ejecting liquid from the certain head unit in accordance with the first drive signal and the second drive signal.

11 Claims, 12 Drawing Sheets

WIDTH W1

| | | DRIVE SIGNAL GENERATION CIRCUIT | | | | | | | | | | | | | | | |
|---|---|---|---|---|---|---|---|---|---|---|---|---|---|---|---|---|---|
| | | 1st | | 2nd | | 3rd | | 4th | | 5th | | 6th | | 7th | | 8th | |
| | | A | B | A | B | A | B | A | B | A | B | A | B | A | B | A | B |
| HEAD UNIT | 1st | ○ | | | | | | | | | ○ | | | | | | |
| | 2nd | | | ○ | | | | | | | | | ○ | | | | |
| | 3rd | | | | | ○ | | | | | | | | | ○ | | |
| | 4th | | | | | | | ○ | | | | | | | | | ○ |
| | 5th | | | | | | | | | | | | | | | | |
| | 6th | | | | | | | | | | | | | | | | |
| | 7th | | | | | | | | | | | | | | | | |
| | 8th | | | | | | | | | | | | | | | | |

FIG. 12

WIDTH W2

| | | DRIVE SIGNAL GENERATION CIRCUIT | | | | | | | | | | | | | | | |
|---|---|---|---|---|---|---|---|---|---|---|---|---|---|---|---|---|---|
| | | 1st | | 2nd | | 3rd | | 4th | | 5th | | 6th | | 7th | | 8th | |
| | | A | B | A | B | A | B | A | B | A | B | A | B | A | B | A | B |
| HEAD UNIT | 1st | ○ | | | | | | | | | ○ | | | | | | |
| | 2nd | | | ○ | | | | | | | | | ○ | | | | |
| | 3rd | | | | | ○ | | | | | | | | | ○ | | |
| | 4th | | | | | | | ○ | | | | | | | | | ○ |
| | 5th | | ○ | | | | | | | ○ | | | | | | | |
| | 6th | | | | ○ | | | | | | | ○ | | | | | |
| | 7th | | | | | | | | | | | | | | | | |
| | 8th | | | | | | | | | | | | | | | | |

FIG. 13

LIQUID EJECTION APPARATUS AND LIQUID EJECTION METHOD

CROSS-REFERENCE TO RELATED APPLICATIONS

The present application claims priority upon Japanese Patent Application No. 2006-193178 filed on Jul. 13, 2006, which is herein incorporated by reference.

BACKGROUND

1. Technical Field

The present invention relates to liquid ejection apparatuses and liquid ejection methods.

2. Related Art

Liquid ejection apparatuses have been proposed such as a printing apparatus provided with a line head unit that can eject ink onto a range corresponding to the width of a printed image (see, for example, Patent Document 1). In the line head unit provided in such liquid ejection apparatuses, head chips each including a plurality of nozzles are arranged in the paper width direction. Moreover, liquid ejection apparatuses have been proposed, in which first drive signals and second drive signals are generated so as to be selectively applied to an element that operates to eject ink (see JP-A-2002-240300, JP-A-2000-52570).

Incidentally, in the above-described line head unit, head chips used for ejecting ink are determined depending on the width of the printed image. For this reason, when an image is printed whose width is shorter than a maximum printable width, some of the chip units are used. At this time, in a configuration in which a plurality of chip units are driven by a plurality of drive signal generation circuits, some of the generation circuits supply the drive signals to the chip units to be operated, whereas the remaining generation circuits do not supply the drive signals. As a result, there will be difference in the operation frequency between some generation circuits and the remaining circuits.

SUMMARY

The invention has been achieved to address the above-described circumstances, and has an advantage of enabling efficient usage of the drive signal generation circuits.

A primary aspect of the invention for achieving the above advantage is a liquid ejection method including:

causing a certain drive signal generation unit to generate a first drive signal and a second drive signal;

causing another drive signal generation unit to generate a first drive signal and a second drive signal;

supplying the first drive signal generated by the certain drive signal generation unit and the second drive signal generated by the other drive signal generation unit to a certain head unit, the certain head unit being one of a plurality of head units arranged in an intersecting direction that intersects a transport direction of a medium; and ejecting liquid from the certain head unit in accordance with the first drive signal and the second drive signal.

Another aspect of the invention for achieving the above advantage is a liquid ejection apparatus including:

a transport mechanism that transports a medium in a transport direction;

a line head unit in which a plurality of head units that eject liquid in accordance with a first drive signal and a second drive signal are arranged in an intersecting direction that intersects the transport direction; and a drive signal generation section, including a plurality of drive signal generation units that generate the first drive signal and the second drive signal, which supplies a first drive signal generated by a certain drive signal generation unit and a second drive signal generated by another drive signal generation unit to a certain head unit.

Features and advantages of the invention other than the above will become clear by reading the description of the present specification with reference to the accompanying drawings.

BRIEF DESCRIPTION OF THE DRAWINGS

FIG. 12 is a diagram illustrating the supply of the drive signals to the head units in the case of printing on paper having a width of W1.

FIG. 13 is a diagram illustrating the supply of the drive signals to the head units in the case of printing on paper having a width of W2.

DESCRIPTION OF EXEMPLARY EMBODIMENTS

Figure 1:
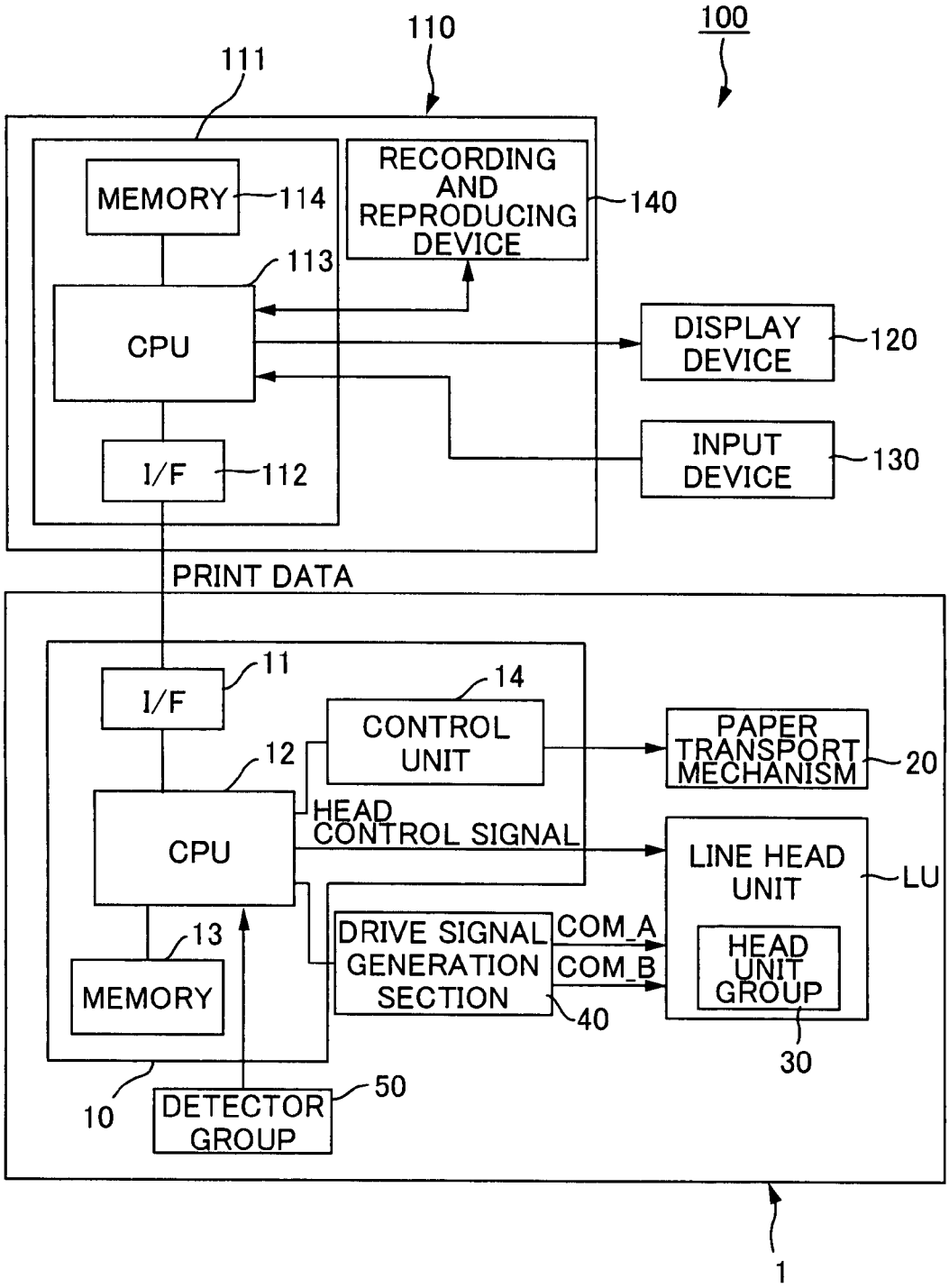
FIG. 1 is a block diagram illustrating a configuration of a printing system.

At least the following matters will be made clear by reading the description of the present specification with reference to the accompanying drawings.

A liquid ejection method includes:

causing a certain drive signal generation unit to generate a first drive signal and a second drive signal;

causing another drive signal generation unit to generate a first drive signal and a second drive signal;

supplying the first drive signal generated by the certain drive signal generation unit and the second drive signal generated by the other drive signal generation unit to a certain head unit, the certain head unit being one of a plurality of head units arranged in an intersecting direction that intersects a transport direction of a medium; and ejecting liquid from the certain head unit in accordance with the first drive signal and the second drive signal.

The second drive signal generated by the certain drive signal generation unit and the first drive signal generated by the other drive signal generation unit are supplied to another head unit.

The head unit includes an element that operates to eject liquid, and causes liquid to be ejected in accordance with the first drive signal and the second drive signal selectively applied to the element.

The head unit includes a first switch for controlling application of the first drive signal to the element, and a second switch for controlling application of the second drive signal to the element, and controls the first switch and the second switch depending on an instructed tone value that defines an ejection amount of liquid so as to selectively apply to the element a necessary portion of the first drive signal and a necessary portion of the second drive signal.

The drive signal generation unit includes:

a first voltage waveform signal generation section that generates a first voltage waveform signal based on a first voltage instruction for defining a voltage waveform of the first drive signal, a second voltage waveform signal generation section that generates a second voltage waveform signal based on a second voltage instruction for defining a voltage waveform of the second drive signal, a first current amplifier section that generates the first drive signal by performing current amplification on the first voltage waveform signal, and a second current amplifier section that generates the second drive signal by performing current amplification on the second voltage waveform signal.

The first current amplifier section includes a pair of transistors connected in a complimentary manner, and the second current amplifier circuit includes another pair of transistors connected in a complimentary manner.

The drive signal generation unit includes:

a voltage instruction input terminal that receives the first voltage instruction and the second liquid ejection instruction, and a timing signal input terminal that receives a timing signal for defining a timing to acquire the first voltage instruction and the second liquid ejection instruction, and the drive signal generation unit acquires one of the first voltage instruction and the second liquid ejection instruction at a rising edge timing of the voltage of the timing signal, and acquires the other of the first voltage instruction and the second liquid ejection instruction at a falling edge timing of the voltage of the timing signal.

The other head unit is disposed shifted in the intersecting direction with respect to the certain head unit, with at least one head unit sandwiched between the other head unit and the certain head unit.

The plurality of head units include:

a first head unit group that has a plurality of the head units arranged in the intersecting direction at a predetermined interval, and arranged in a certain position in the transport direction, and a second head unit group that has a plurality of the head units arranged in the intersecting direction at the predetermined interval, and arranged in another position in the transport direction.

The plurality of head units of the second head unit group are arranged shifted in the intersecting direction with respect to the plurality of head units of the first head unit group.

A liquid ejection apparatus includes:

a transport mechanism that transports a medium in a transport direction;

a line head unit in which a plurality of head units that eject liquid in accordance with a first drive signal and a second drive signal are arranged in an intersecting direction that intersects the transport direction; and a drive signal generation section, including a plurality of drive signal generation units that generate the first drive signal and the second drive signal, which supplies a first drive signal generated by a certain drive signal generation unit and a second drive signal generated by another drive signal generation unit to a certain head unit.

A printing apparatus includes:

a transport mechanism for transporting a medium in a transport direction;

a line head unit in which a plurality of head units that eject ink in accordance with a first drive signal and a second drive signal are arranged shifted in an intersecting direction that intersects the transport direction; and a drive signal generation section including a plurality of drive signal generation units for generating the first drive signal and the second drive signal that supplies a first drive signal generated by a certain drive signal generation unit and a second drive signal generated by another drive signal generation unit to a certain head unit.

With such a printing apparatus, when ink is ejected from a certain head unit, supply of the first drive signal and supply of the second drive signal can be separately carried out by a certain drive signal generation unit and another drive signal generation unit. Therefore, these drive signal generation units can be efficiently used.

In such a printing apparatus, it is preferable that the drive signal generation unit supplies the second drive signal generated by the certain drive signal generation unit and the first drive signal generated by the another drive signal generation unit to another head unit.

With such a printing apparatus, when ink is ejected from both of a certain head unit and another head unit, drive signals from a certain drive signal generation unit and another drive signal generation unit are used. Therefore, these drive signal generation units can be efficiently used.

In such a printing apparatus, it is preferable that the head unit is a configuration that includes an element that operates to eject ink, and causes the ink to be ejected in accordance with the first drive signal and the second drive signal selectively applied to the element.

With such a printing apparatus, it is possible to vary the ink ejection amount.

In such a printing apparatus, it is preferable that the head unit is a configuration that includes a first switch for controlling application of the first drive signal to the element, and a second switch for controlling application of the second drive signal to the element, and controls the first switch and the second switch depending on an instructed tone value that defines an ejection amount of ink so as to selectively apply to the element a necessary portion of the first drive signal and a necessary portion of the second drive signal.

With such a printing apparatus, it is possible to determine the ink ejection amount in accordance with the necessary portion of the first drive signal and the necessary portion of the second drive signal applied to the element. Therefore, it is possible to finely control the ink ejection amount.

In such a printing apparatus, it is preferable that the drive signal generation unit is a configuration that includes a first voltage waveform signal generation section that generates a first voltage waveform signal based on a first voltage instruction for defining a voltage waveform of the first drive signal, a first voltage waveform signal generation section that generates a second voltage waveform signal based on a second voltage instruction for defining a voltage waveform of the second drive signal, a first current amplifier section that generates the first drive signal by performing current amplification on the first voltage waveform signal, and a second current amplifier section that generates the second drive signal by performing current amplification on the second voltage waveform signal.

With such a printing apparatus, it is possible to generate the first drive signal and the second drive signal that have complicated waveforms depending on the voltage instructions.

In such a printing apparatus, it is preferable that the first current amplifier section is constituted by a pair of transistors connected in a complimentary manner, and the second current amplifier circuit is constituted by another pair of transistors connected in a complimentary manner.

With such a printing apparatus, it is possible to amplify electric currents with a simple configuration.

In such a printing apparatus, it is preferable that the drive signal generation unit is a configuration that includes a voltage instruction input terminal that receives the first voltage instruction and the second print instruction, and a timing signal input terminal that receives a timing signal for defining a timing to acquire the first voltage instruction and the second print instruction, and the drive signal generation unit acquires one of the first voltage instruction and the second print instruction at a rising edge timing of the voltage of the timing signal, and acquires the other of the first voltage instruction and the second print instruction at a falling edge timing of the voltage of the timing signal.

With such a printing apparatus, it is possible to input the first voltage instruction and the second voltage instruction with a common voltage instruction input terminal. Therefore, it is possible to make the configuration simple.

In such a printing apparatus, it is preferable that the other head unit is disposed shifted in the intersecting direction with respect to the certain head unit, with at least one head unit sandwiched between the other head unit and the certain head unit.

With such a printing apparatus, electric power consumed in a certain drive signal generation unit and another drive signal generation unit are determined depending on the width of the print image. Therefore, it is possible to significantly suppress power consumption when an image to be printed has a comparatively small width.

In such a printing apparatus, the line head units include a first head unit group that has a plurality of the head units arranged in the intersecting direction at a predetermined interval, and arranged in a certain position in the transport direction, and a second head unit group that has a plurality of the head units arranged in the intersecting direction at the predetermined interval, and arranged in another position in the transport direction.

With such a printing apparatus, it is possible to arrange a large number of head units in a limited space.

In such a printing apparatus, it is preferable that the plurality of head units constituting the second head unit group are arranged shifted in the intersecting direction with respect to the plurality of head units constituting the first head unit group.

With such a printing apparatus, it is possible to arrange a large number of head units in a limited space.

Also, it is made clear that a printing apparatus configured as described below can be achieved.

That is, a printing apparatus can be achieved that includes (A) a transport mechanism that transports a medium in a transport direction, (B) a line head unit in which a plurality of head units are arranged shifted in an intersecting direction that intersects the transport direction, the head unit including an element that operates to eject ink, a first switch for controlling application of the first drive signal to the element, and a second switch for controlling application of a second drive signal to the element, and controlling the first switch and the second switch depending on an instructed tone value that defines an ejection amount of ink so as to selectively apply to the element a necessary portion of the first drive signal and a necessary portion of the second drive signal, and causing the ink to be ejected in accordance with the necessary portions of the first drive signal and the second drive signal selectively applied to the element, and that includes a first head unit group that has a plurality of the head units arranged in the intersecting direction at a predetermined interval, and arranged in a certain position in the transport direction, and a second head unit group that has a plurality of the head units arranged in the intersecting direction at the predetermined interval, and arranged in another position in the transport direction, (C) a drive signal generation section, including a plurality of drive signal generation units that generate the first drive signal and the second drive signal, which supply the first drive signal generated by a certain drive signal generation unit and the second drive signal generated by another drive signal generation unit to a certain head unit, and the second drive signal generated by the certain drive signal generation unit and the first drive signal generated by the other drive signal generation unit are supplied to another head unit, wherein (D) the drive signal generation unit includes a first voltage waveform signal generation section that generates a first voltage waveform signal based on a first voltage instruction for defining a voltage waveform of the first drive signal, a second voltage waveform signal generation section that generates a second voltage waveform signal based on a second voltage instruction for defining a voltage waveform of the second drive signal, a first current amplifier section that generates the first drive signal by performing current amplification on the first voltage waveform signal, a second current amplifier section that generates the second drive signal by performing current amplification on the second voltage waveform signal, a voltage instruction input terminal that receives the first voltage instruction and the second print instruction, and a timing signal input terminal that receives a timing signal for defining a timing to acquire the first voltage instruction and the second print instruction, wherein one of the first voltage instruction and the second print instruction is acquired at a rising edge timing of the voltage of the timing signal, and the other of the first voltage instruction and the second print instruction is acquired at a falling edge timing of the voltage of the timing signal, (E) the first current amplifier section includes a pair of transistors connected in a complimentary manner, (F) the second current amplifier circuit includes another pair of transistors connected in a complimentary manner, (G) the plurality of head units constituting the second head unit group are arranged shifted in the intersecting direction with respect to the plurality of head units constituting the first head unit group, and (H) the other head unit is disposed shifted in the intersecting direction with respect to the certain head unit, with at least one head unit sandwiched between the other head unit and the certain head unit.

With such a printing apparatus, the advantage of the invention is achieved in a most efficient manner, since it realizes substantially all the effects described above.

Also, it is made clear that a printing method described below can be achieved.

That is, a printing method can be achieved that includes the steps of (A) causing a certain drive signal generation unit to generate a first drive signal and a second drive signal, (B) causing another drive signal generation unit to generate a first drive signal and a second drive signal, and (C) causing a certain head unit of a line head unit in which a plurality of head units arranged shifted in an intersecting direction that intersects a transport direction of a medium to eject ink by supplying the first drive signal generated by the certain drive signal generation unit and the second drive signal generated by the other drive signal generation unit to the certain head unit.

First Embodiment

Overall Configuration of Printing System 100

As shown in FIG. 1, a printing system 100 includes a printer 1, a computer 110, a display device 120, an input device 130, and a recording and reproducing device 140. The printer 1 corresponds to a printing apparatus, and prints images on media such as paper S (see FIG. 2A), clothes, films and the like. The media used herein refer to objects on which ink ejected from head units 30A to 30H (see FIG. 3) lands. The computer 110 is communicably connected to the printer 1. In order to print an image with the printer 1, the computer 110 outputs print data corresponding to that image to the printer 1. The computer 110 has computer programs such as an application program and a printer driver installed thereon. The display device 120 is CRT or a liquid display device 120, for example. The input device 130 is a keyboard or the like, and the recording and reproducing device 140 is a flexible disk drive device or the like. Note that the recording and reproducing device 140 is attached to a housing of the computer 110.

Regarding Configuration of Computer 110

The computer 110 includes a host-side controller 111. The host-side controller 111 performs various controls in the computer 110 and is also communicably connected to the display device 120, the input device 130 and the recording and reproducing device 140. The host-side controller 111 includes an interface section 112, a CPU 113, and a memory 114. The interface section 112 exchanges data with the printer 1. The CPU 113 is a computation processing unit for performing the overall control of the computer 110. The memory 114 is for reserving an area for storing computer programs used by the CPU 113 and a working area, for example. The CPU 113 performs various controls according to the computer programs stored in the memory 114.

Figure 7:
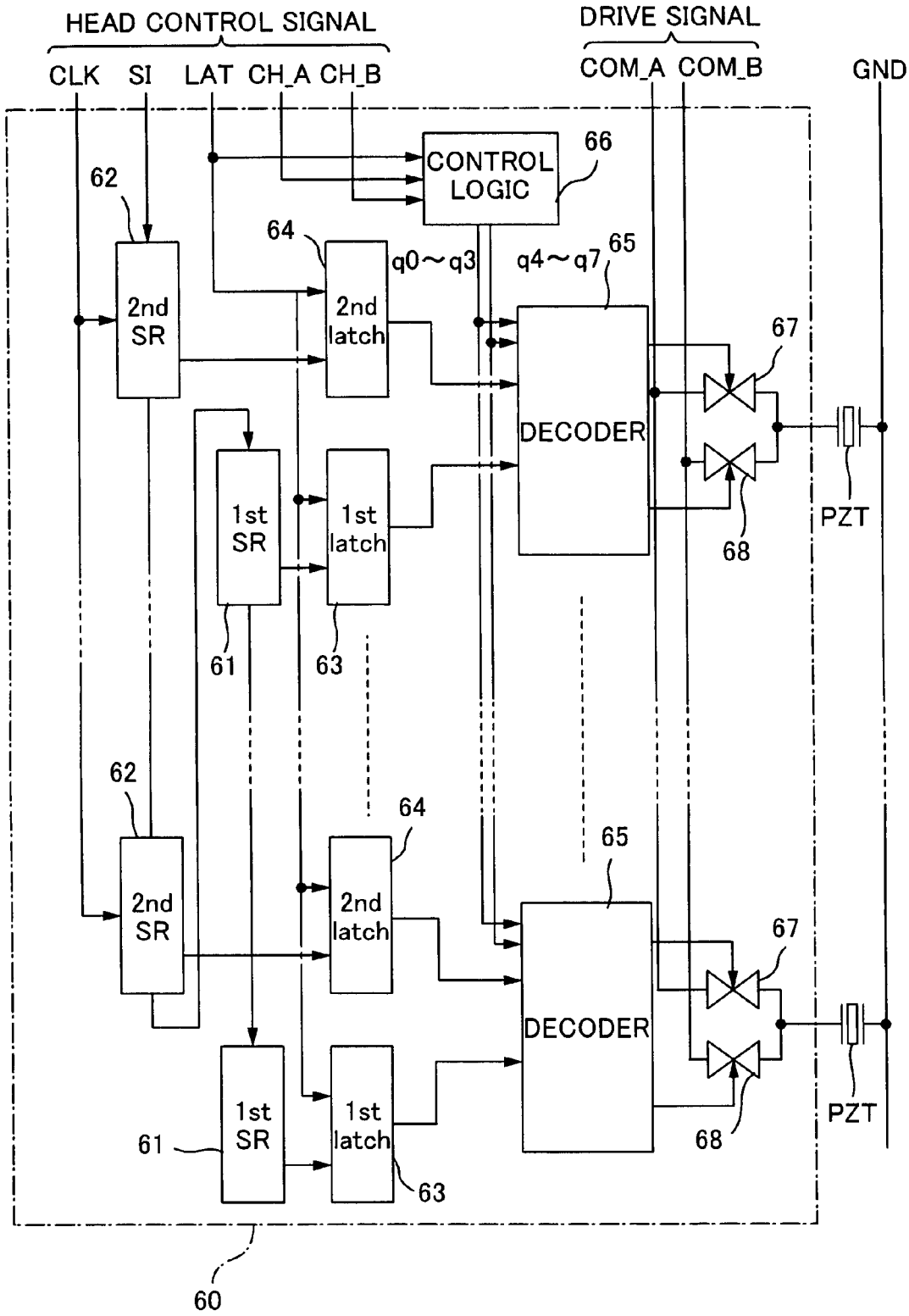
FIG. 7 is a block diagram illustrating a configuration of a head controller.

Print data outputted form the computer 110 is data in a format that can be interpreted by the printer 1, and contains various types of command data and dot formation data SI (see FIG. 7). The command data is data for directing the printer 1 to execute a particular operation. The dot formation data SI is data relating to the size of dots formed on paper S. That is, the dot formation data SI is made up of an instructed tone value group that represents the dot tone for each nozzle Nz. Each instructed tone value is set for each unit region. The unit region is a virtual rectangular region arranged on a medium such as paper S. The size of a dot is determined by the amount of ink (one type of liquid) that is to be ejected. Accordingly, the instructed tone value is information that defines the amount of ink to be ejected. Note that in this printer 1, the instructed tone value is made up of 2-bit data. Therefore, formation of dots can be controlled in four dot tone levels for each unit region.

Printer 1

Regarding Configuration of Printer 1

Next, the configuration of the printer 1 is described. As shown in FIG. 1, the printer 1 includes a printer-side controller 10, a paper transport mechanism 20, a line head unit LU (head unit group 30), a drive signal generation section 40, and a detector group 50.

Regarding Printer-side Controller 10

In the printer 1, the printer-side controller 10 controls the sections to be controlled, i.e., the paper transport mechanism 20, the head unit group 30, and the drive signal generation section 40. The printer-side controller 10 includes an interface section 11, a CPU 12, a memory 13, and a control unit 14. The interface section 11 exchanges data with the computer 110, which is an external apparatus. The CPU 12 is a computation processing unit for performing the overall control of the printer 1. The memory 13 is for reserving an area for storing programs for the CPU 12 and a working area, for example, and is constituted by a RAM, an EEPROM, or a ROM. The CPU 12 controls the sections to be controlled according to computer programs stored in the memory 13. The control unit 14 outputs control signals directed to the paper transport mechanism 20. For example, the control unit 14 outputs operation signals for operating a transport motor 21 in the paper transport mechanism 20.

Regarding Paper Transport Mechanism 20

Figure 2A:
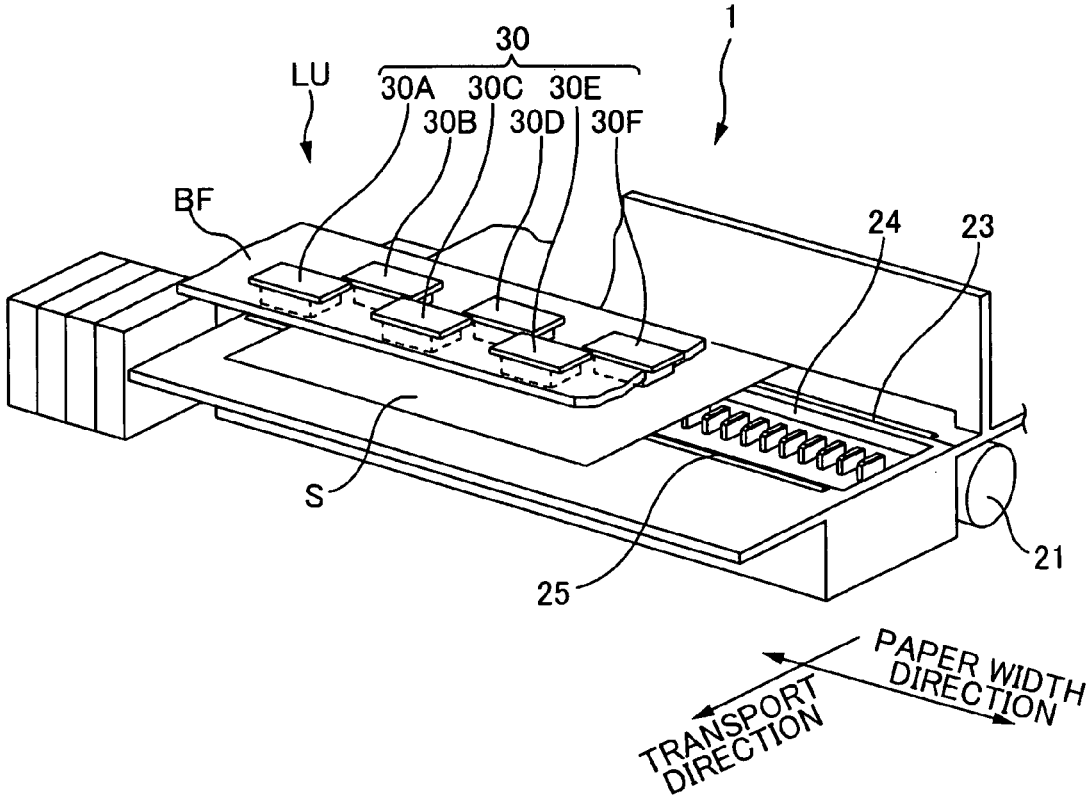
FIG. 2A is a perspective view illustrating an internal configuration of a printer.
Figure 2B:
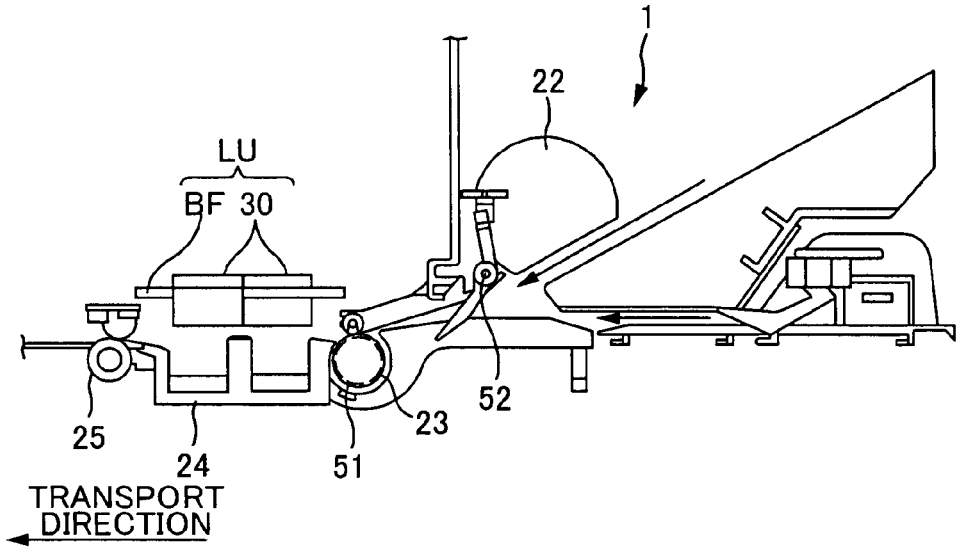
FIG. 2B is a side view illustrating an internal configuration of a printer.

The paper transport mechanism 20 is for transporting paper S as a medium in a transport direction by a predetermined transport amount, and corresponds to a transport mechanism for transporting media in the transport direction. As shown in FIGS. 2A and 2B, the paper transport mechanism 20 includes the transport motor 21, a paper supply roller 22, a transport roller 23, a platen 24, and a discharge roller 25. The transport motor 21 serves as a drive source for transporting the paper S in the transport direction. The paper supply roller 22 transports the paper S inserted to a paper insertion opening to the internal side of the printer 1. The transport roller 23 transports the paper S transported by the paper supply roller 22 to a print position. The platen 24 supports the paper S on the back side thereof. The discharge roller 25 transports the paper S for which printing has finished in a discharge direction.

The transport motor 21 operates in accordance with control signals from the printer-side controller 10. The motive power provided by the transport motor 21 causes the paper supply roller 22, the transport roller 23 and the discharge roller 25 to operate. Therefore, the printer-side controller 10 corresponds to a controller that controls movement of the paper S.

Regarding Line Head Unit LU

Figure 3:
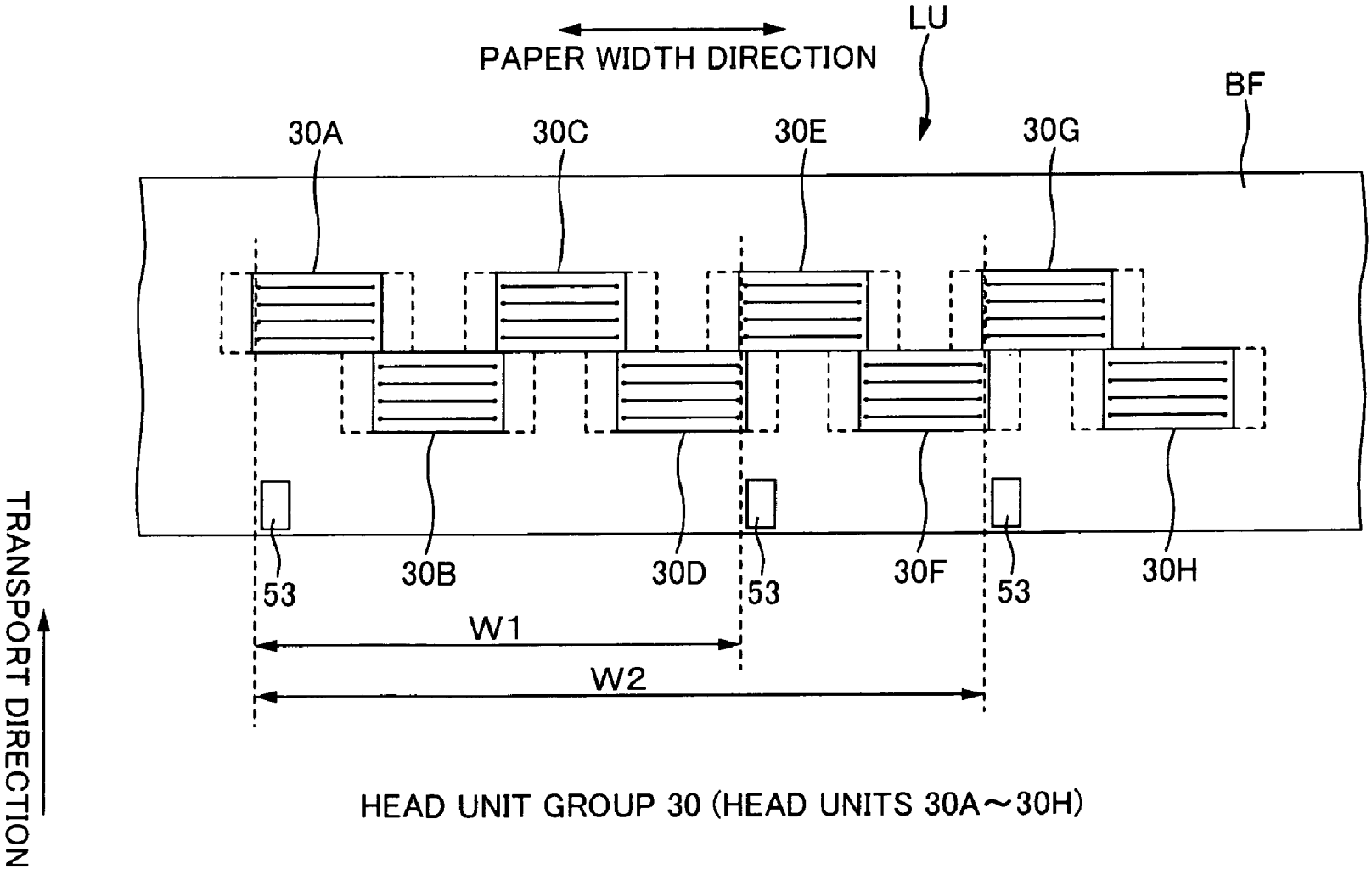
FIG. 3 is a diagram of a line head unit viewed from the nozzle row side.
Figure 4A:
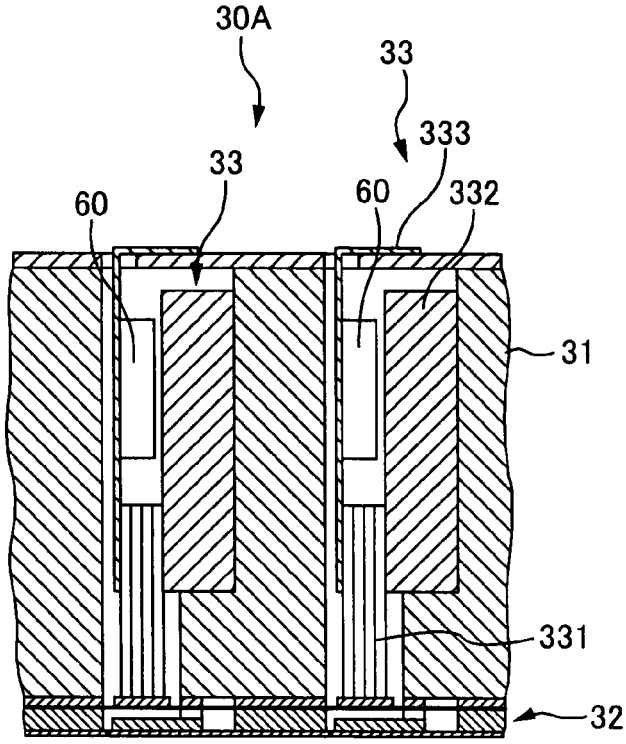
FIG. 4A is a cross-sectional view for explaining an internal structure of a head unit.

As shown in FIG. 3 and FIG. 4A, the line head unit LU includes a base frame BF and the head unit group 30 (a plurality of the head units 30A to 30H). The base frame BF is a rectangular-shaped plate member elongated in an intersecting direction that intersects the transport direction, as shown also in FIG. 2A. The intersecting direction in the present embodiment is a direction that is orthogonal to the transport direction. Accordingly, the intersecting direction corresponds to the paper width direction. On the base frame BF are formed through holes through which only the main body of the head unit, and not a flange portion thereof, can pass.

The head units 30A to 30H constituting the head unit group 30 are attached to the base frame BF in a zigzag form. In the line head unit LU, eight head units 30A to 30H are attached to one base frame BF. Four head units 30A, 30C, 30E and 30G constitute a downstream side head unit group (corresponding to a first head unit group), and arranged at predetermined intervals in the paper width direction. The remaining four head units 30B, 30D, 30F and 30H constitute an upstream side head unit group (corresponding to a second head unit group), and also arranged at predetermined intervals in the paper width direction. Furthermore, the four head units 30A, 30C, 30E and 30G constituting the upstream side head unit group are arranged with their respective positions shifted in the paper width direction relative to the four head units 30B, 30D, 30F and 30H constituting the downstream side head unit group. This configuration makes it possible to arrange many head units in a limited space on the base frame BF.

Regarding Head Units 30A to 30H

Figure 4B:
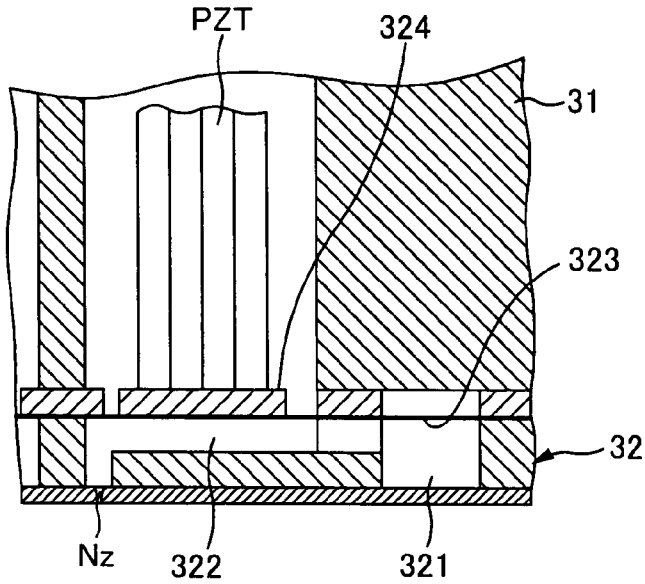
FIG. 4B is a cross-sectional view for explaining a main portion of the head unit.

Next, the head units 30A to 30H, which constitute the head unit group 30, will be described. The head units 30A to 30H all have the same configuration. Therefore, the head unit 30A is described, and the remaining head units 30B to 30H will not be described. As shown in FIGS. 4A and 4B, the head unit 30A includes a housing 31, a flow path unit 32 and a piezo element unit 33. The housing 31 is a member for accommodating the piezo element unit 33. In the flow path unit 32, a plurality of flow paths running from a common ink chamber 321 to the nozzle Nz through a pressure chamber 322 are provided, the number of the paths corresponding to that of the nozzles Nz. Part of the pressure chamber 322 is partitioned by an elastic film 323. On the surface of the elastic film 323 on the side opposite to the pressure chamber 322, an island section 324 is provided for each pressure chamber 322. The piezo element unit 33 includes a piezo element group 331, a bonding plate 332, and an element wiring substrate 333. The piezo element group 331 is comb-shaped, and each tooth portion corresponds to a piezo element PZT. The piezo element PZT expands and contracts in a longitudinal direction thereof depending on the potential difference caused by an applied portion of a drive signal COM (a first drive signal COM_A, and second drive signal COM_B, see FIG. 6A). The piezo element group 331 is fixed to the housing 31 via the bonding plate 332. The leading end surface of each piezo element PZT is bonded to the island section 324. Therefore, when the piezo element PZT expands and contracts in the longitudinal direction thereof, the island section 324 is pushed toward the pressure chamber 322, or is pulled to the opposite direction. Accordingly, the pressure on the ink in the pressure chamber 322 varies so that the ink is ejected from the nozzle Nz. Therefore, the piezo element PZT corresponds to an element that operates in order to eject ink. The element wiring substrate 333 is a wiring member for applying a necessary portion of the drive signal COM to each piezo elements PZT. A head controller 60 is mounted on the element wiring substrate 333.

Figure 5:
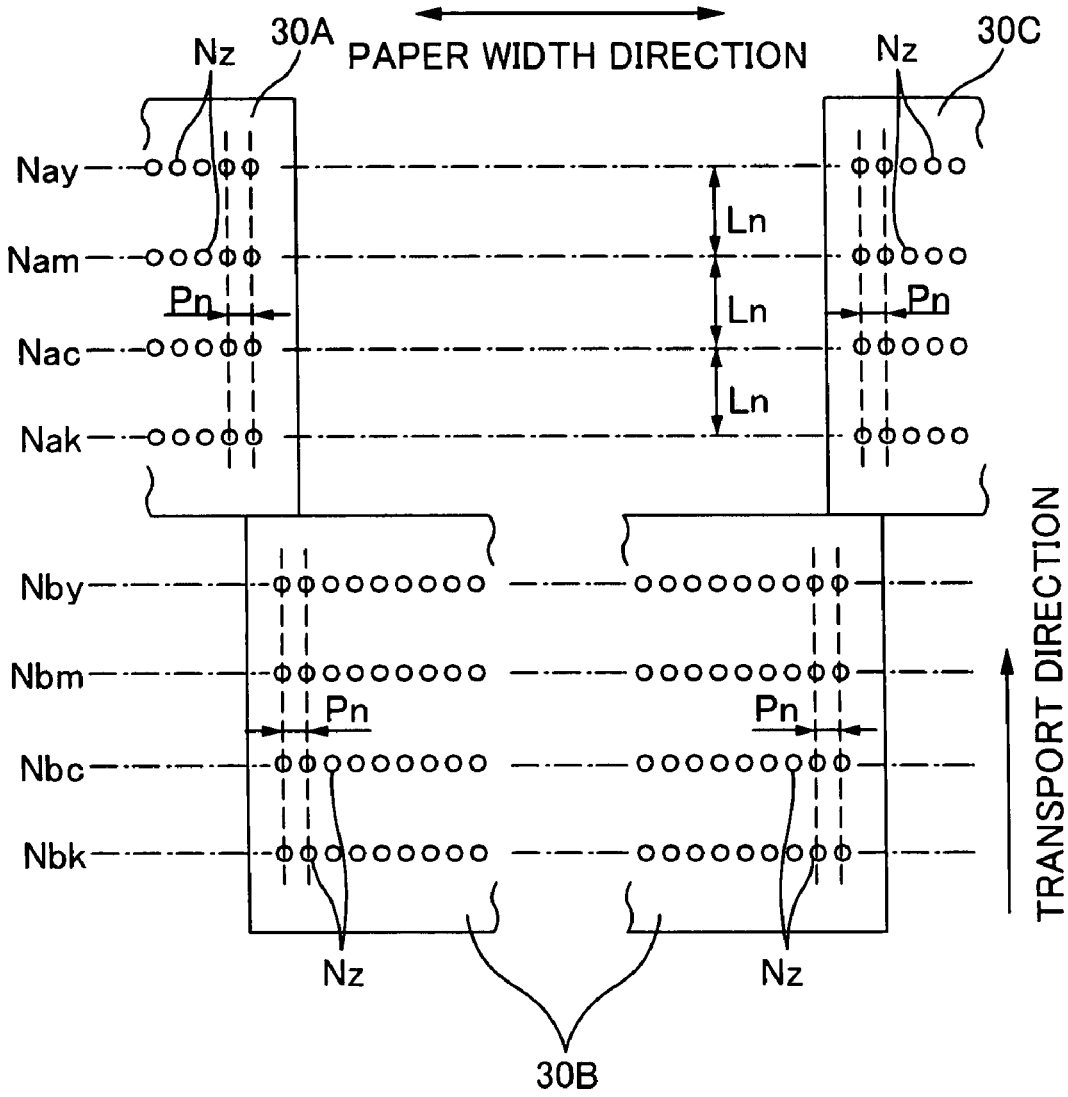
FIG. 5 is an enlarged view for explaining the arrangement of nozzles.

Regarding Positional Relationship of Nozzles Nz and Head Units 30A to 30H Next, the positional relationship of the nozzles Nz and the head units 30A to 30H is described. As partially shown in FIG. 5, a plurality of nozzles Nz provided in each of the head units 30A to 30H are formed in a row in a predetermined direction (arrangement direction of piezo element PZT), thereby forming a nozzle row. A single nozzle row is constituted by a predetermined number of nozzles Nz. The nozzles Nz belonging to the same nozzle row are formed at a constant interval Pn.

The head units 30A to 30H respectively include four nozzle rows. In the present embodiment, the nozzle rows are formed parallel to each other. A formation interval Ln between adjacent nozzle rows is defined by the print resolution. Specifically, the formation interval Ln is defined to be an integral multiple of the print resolution. This is for aligning the landing positions of the inks ejected from different nozzle rows.

As shown in FIG. 3, the four head units 30A, 30C, 30E and 30G constituting the downstream side head unit group are attached lined up in the paper width direction at predetermined intervals. In a similar manner, the four head units 30B, 30D, 30F and 30H constituting the upstream side head unit group are attached lined up in the paper width direction at predetermined intervals in the paper width direction. In this attachment state, a plurality of nozzles Nz belonging to the same nozzle row are each linearly arranged in the paper width direction. The four head units 30A, 30C, 30E and 30G constituting the downstream side head unit group are respectively attached such that the positions in the transport direction of their respective corresponding nozzle rows are aligned. In a similar manner, the four head units 30B, 30D, 30F and 30H constituting the upstream side head unit group are respectively attached such that the positions in the transport direction of their respective corresponding nozzle rows are aligned. Then, when regarding four nozzle rows arranged aligned in the paper width direction as one nozzle row group, the downstream side head unit group (30A, 30C, 30E and 30G) can be regarded as including four nozzle row groups. Similarly, the upstream side head unit group (30B, 30D, 30F and 30H) can be also regarded as including four nozzle row groups.

Of the four nozzle row groups in the downstream side head unit group, a nozzle row group Nay on the furthest downstream side ejects yellow ink, a second furthest nozzle row group Nam ejects magenta ink, a third furthest nozzle row group Nac ejects cyan ink, and a nozzle row group Nak on the furthest upstream side ejects black ink. Similarly, in the four nozzle row groups in the upstream side head unit group, a nozzle row group Nby on the furthest downstream side ejects yellow ink, a second nozzle row group Nbm ejects magenta ink, a third nozzle row group Nbc ejects cyan ink, and a nozzle row group Nbk on the furthest upstream side ejects black ink. Then, the head units 30A to 30H are arranged such that the nozzles Nz constituting the downstream side nozzle row group and the nozzles Nz constituting the upstream side nozzle row group are all arranged so as to maintain constant intervals (predetermined pitch Pn) even at their boundary portions in the paper width direction. As a result, the nozzles Nz ejecting the same color of ink are arranged at constant intervals in terms of the paper width direction.

Regarding the Drive Signal Generation Section 40

The drive signal generation section 40 is constituted by drive signal generation circuits 40A to 40H (each of them corresponds to a drive signal generation unit), the number of which corresponds to that of the head units 30A to 30H. The drive signal generation section 40 of this embodiment is constituted by eight drive signal generation circuits 40A to 40H, the same number as the head units 30A to 30H (see FIG. 8). The drive signal generation circuits 40A to 40H generate drive signals COM to be used in common when driving the above-described piezo element PZT. The drive signal generation circuit of this embodiment generates a plurality of types of drive signals COM concurrently during a certain period. For example, it repeatedly generates the first drive signals COM_A and the second drive signals COM_B concurrently during a period T. The configuration of the drive signal generation section 40 will be described later, and now the first drive signal COM_A and second drive signal COM_B to be generated are described.

Regarding Drive Signals COM Generated

Figure 6A:
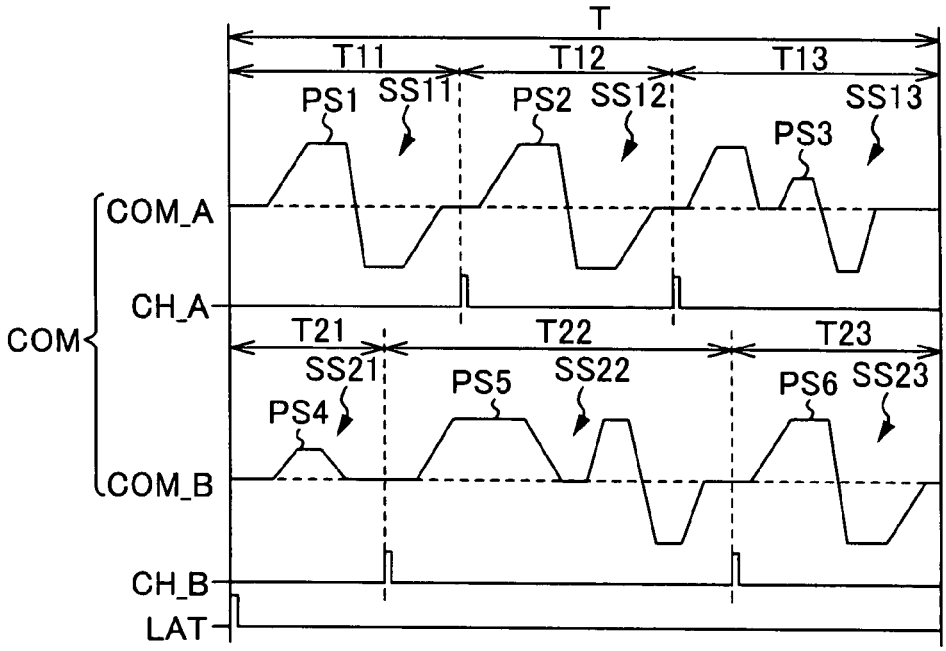
FIG. 6A is a diagram illustrating a drive signal generated.

As shown in FIG. 6A, the first drive signal COM_A is made up of a waveform portion SS11 generated during a period T11, a waveform portion SS12 generated during a period T12, a waveform portion SS13 generated during a period T13. These waveform portions SS11 to SS13 contain drive pulses for causing the piezo element PZT to perform a predetermined operation. That is, the waveform portion SS11 contains a first drive pulse PS1. The waveform portion SS12 contains a second drive pulse PS2, and the waveform portion SS13 contains a third drive pulse PS3. The second drive signal COM_B is made up of a waveform portion SS21 generated during a period T21, a waveform portion SS22 generated during a period T22, a waveform portion SS23 generated during a period T23. These waveform portions SS21 to SS23 also contain drive pulses for causing the piezo element PZT to perform a predetermined operation. That is, the waveform portion SS21 contains a fourth drive pulse PS4, the waveform portion SS22 contains a fifth drive pulse PS5, and the waveform portion SS23 contains a sixth drive pulse PS6.

The fourth drive pulse PS4 is a micro-vibration pulse. When the fourth drive pulse PS4 is applied to the piezo element PZT, the ink in the pressure chamber 322 is subjected to a pressure variation which is too small to cause ink ejection, and consequently the meniscus (free surface of the ink exposed from the nozzle Nz) is micro-vibrated. On the other hand, the drive pulses other than the fourth drive pulse PS4 are ejection pulses for causing the piezo element PZT to perform an ejection operation to eject ink. Of these other drive pulses, the fifth drive pulse PS5 is a pulse for small dot formation. That is, the fifth drive pulse PS5 causes ink ejection in an amount suitable for forming a small dot. In this embodiment, when the fifth drive pulse PS5 is applied to the piezo element PZT, approximately 3 pL of ink is ejected from the nozzle Nz. The third drive pulse PS3 is a pulse for medium dot formation. That is, the third drive pulse PS3 causes ink ejection in an amount suitable for forming a medium dot. In this embodiment, when the third drive pulse PS3 is applied to the piezo element PZT, approximately 5 pL of ink is ejected from the nozzle Nz. The remaining drive pulses, namely, the first drive pulse PS1, the second drive pulse PS2, and the sixth drive pulse PS6 are pulses for large dot formation. That is, these drive pulses cause ink ejection in an amount suitable for forming a large dot. In this embodiment, when these three drive pulses are applied to the piezo element PZT, approximately 21 pL of ink in total is ejected from the nozzle Nz.

Regarding Detector Group 50

The detector group 50 is for monitoring the conditions inside the printer 1. The detector group 50 includes, for example, a rotary encoder 51 and a paper detector 52 shown in FIG. 2B, and a paper width detector 53 shown in FIG. 3. The rotary encoder 51 is for detecting the rotation amount of the transport roller 23. The paper detector 52 is for detecting the presence or absence of the paper S. The paper width detector 53 detects the width of paper S to be printed on, and in this embodiment is constituted by a plurality of reflection-type sensors. These reflection-type sensors are arranged with their respective positions shifted in the paper width direction so as to cope with a plurality of standardized paper sizes. In this case, one sensor is arranged at a reference position, one at a position corresponding to the width W1, and one at a position corresponding to the width W2. That is, they are arranged at positions such that the side edges of paper S having different widths can be detected. The detector group 50 outputs the detection results to the printer-side controller 10.

Regarding Head Controller 60

Next, the head controller 60 is described. As described above, the head controller 60 is provided for each piezo element unit 33. As shown in FIG. 7, the head controller 60 is provided with a first shift register 61, a second shift register 62, a first latch circuit 63, a second latch circuit 64, a decoder 65, a control logic 66, a first switch 67, and a second switch 68. Each of the above components other than the control logic 66 is provided for each piezo element PZT. Because the piezo element PZT is provided for each nozzle Nz from which ink is ejected, each of these components is therefore provided for each nozzle Nz.

The higher order bits of the instructed tone values constituting the dot formation data SI are set in the first shift register 61. The lower order bits of the instructed tone values are set in the second shift register 62. The first latch circuit 63 latches data set in the first shift register 61 (the higher order bit of the instructed tone value) at a timing defined by a latch signal LAT. The second latch circuit 64 latches data set in the second shift register 62 (the lower order bit of the instructed tone value) at a timing defined by the latch signal LAT. As a result of the higher order bit and lower order bit being latched by the first latch circuit 63 and the second latch circuit 64 respectively, the instructed tone value is obtained for each nozzle Nz as a pair of higher order bit and lower order bit. The decoder 65 performs decoding based on the instructed tone value obtained from the first latch circuit 63 and the second latch circuit 64, and outputs switch control signals for controlling the first switch 67 and the second switch 68. The switch control signal is a signal selected from among a plurality of types of selection data q0 to q7 that are outputted from the control logic 66. The selection data q0 to q7 will be described later. The first switch 67 controls application of the first drive signal COM_A to the piezo element PZT. The second switch 68 controls application of the second drive signal COM_B to the piezo element PZT. In this embodiment, during the period in which the switch control signal is at "H" level, the corresponding switches become connected. That is, when the selection data selected by the decoder 65 is data [1], necessary portions of the first drive signal COM_A and the second drive signal COM_B are applied to the piezo element PZT.

Now the selection data q0 to q7 are described. The selection data q0 to q3 represent the selection patterns of the waveform portions SS11 to SS13 of the first drive signal COM_A for each instructed tone value (each dot tone). The selection data q0 represents the selection pattern of the first drive signal COM_A in the case of the instructed tone value [00] (no dot). The selection data q1 represents the selection pattern of the first drive signal COM_A in the case of the instructed tone value [01] (small dot formation). Similarly, the selection data q2 represents the selection pattern of the first drive signal COM_A in the case of the instructed tone value [10] (medium dot formation). The selection data q3 represents the selection pattern of the first drive signal COM_A in the case of the instructed tone value [11] (large dot formation). The selection data q4 to q7 represent the selection patterns of the second drive signal COM_B for each instructed tone value. That is, the selection data q4 represents the selection pattern of the first drive signal COM_A in the case of the instructed tone value [00]. Similarly, the selection data q5, q6, and q7 respectively represent the selection patterns of the second drive signal COM_B in the case of the instructed tone values [01], [10], and [11].

Figure 6B:
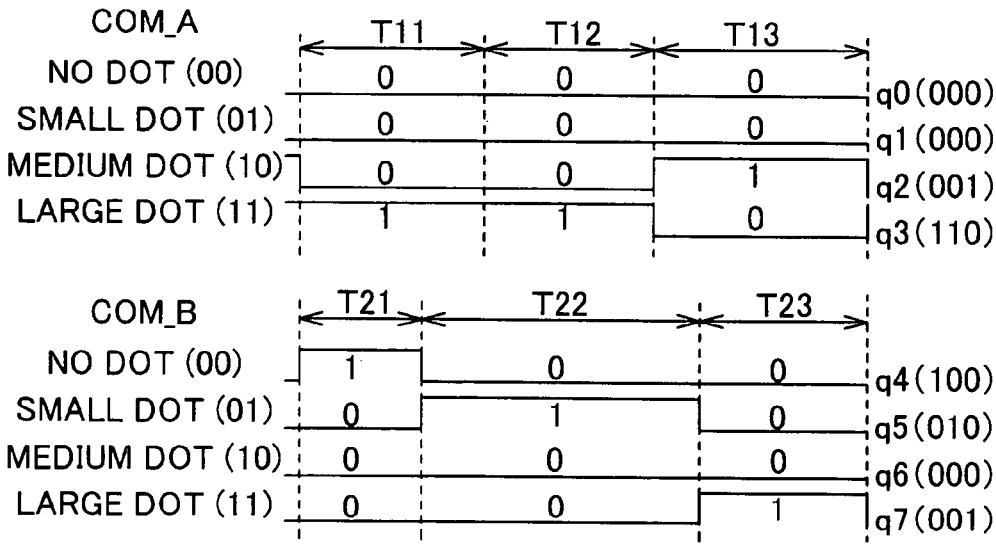
FIG. 6B is a diagram illustrating the portion of the drive signal that is applied to a piezo element for each dot tone.

As shown in FIG. 6B, the selection data q0 is indicated as data [000], and the selection data q4 is indicated as data [100].

These selection data q0 and q4 are switched at a timing defined by a first change signal CH_A and a second change signal CH_B (this also applies to other selection data). Therefore, when the instructed tone value is [00], the waveform portion SS21 is applied to the piezo element PZT. As a result, the meniscus is micro-vibrated in response to the fourth drive pulse PS4. The selection data q1 is indicated as data [000], the selection data q5 is indicated as data [010]. Therefore, when the instructed tone value is [01], the waveform portion SS22 is applied to the piezo element PZT. As a result, ink is ejected in an amount suitable for forming a small dot in response to the fifth drive pulse PS5. The selection data q2 is indicated as data [001], and the selection data q6 is indicated as data [000]. Therefore, when the instructed tone value is [10], the waveform portion SS13 is applied to the piezo element PZT. As a result, ink is ejected in an amount suitable for forming a medium dot in response to the third drive pulse PS3. The selection data q3 is indicated as data [110], and the selection data q7 is indicated as data [001]. Therefore, when the instructed tone value is [11], the waveform portions SS11, SS12 and SS23 are applied to the piezo element PZT. As a result, ink is ejected in an amount suitable for forming a large dot in response to the first drive pulse PS1, second drive pulse PS2, and sixth drive pulse PS6.

The above-described configuration allows the ink ejection amount to be determined depending on necessary portions of the first drive signal COM_A and the second drive signal COM_B applied to the piezo element PZT. Therefore, the ink ejection amount can be finely controlled.

Detailed Description of Drive Signal Generation Section 40

The drive signal generation section 40 is constituted by drive signal generation circuits 40A to 40H, the number of which corresponds to that of the head units 30A to 30H. In a general configuration, the first drive signal COM_A and the second drive signal COM_B generated by a certain drive signal generation circuit are applied to a certain head unit, for the reason that wiring can be simplified or the like. When it is assumed that such a general configuration is applied to the printer 1, the following problem is conceived.

In the printer 1, head units that can eject ink are selected in accordance with the size of paper S. For example, when printing is performed on the paper S whose width is one-fourth a maximum printing width, two head units from the left end in FIG. 3, namely the head units 30A and 30B, are selected. When printing is performed on the paper S whose width is half a maximum printing width, four head units from the left end in FIG. 3, namely the head units 30A to 30D, are selected. Similarly, when printing is performed on the paper S having a maximum printing width, all the head units 30A to 30H are selected. Accordingly, head units disposed on the further left side in FIG. 3 are used more frequently. When a general configuration is employed, the operation frequency of the drive signal generation circuits 40A to 40H also varies depending on the use frequency of their corresponding head units 30A to 30H.

Here, the drive signal generation circuits 40A to 40H are required to pass an electric current in an amount that corresponds to the number of piezo elements PZT to be operated. Therefore, the more the number of piezo elements to be operated is, the larger the current amount that passes through the circuit becomes, which produces heat. As a result, the amount of heat produced may vary between a certain drive signal generation circuit and other drive signal generation circuits. In terms of circuit stability, it is preferable that such variance in the generated heat amount is as small as possible.

Accordingly, the printer 1 employs a configuration in which a first drive signal COM_A generated by a certain drive signal generation circuit and a second drive signal COM_B generated by another drive signal generation circuit are supplied to a certain head unit. In this manner, when a certain head unit is driven, the first drive signal COM_A and the second drive signal COM_B are supplied from different drive signal generation circuits. As a result, when printing is performed on the paper S whose width is shorter than a maximum printing width, a larger number of drive signal generation circuits can be efficiently used. Detailed description will be provided below.

Figure 9:
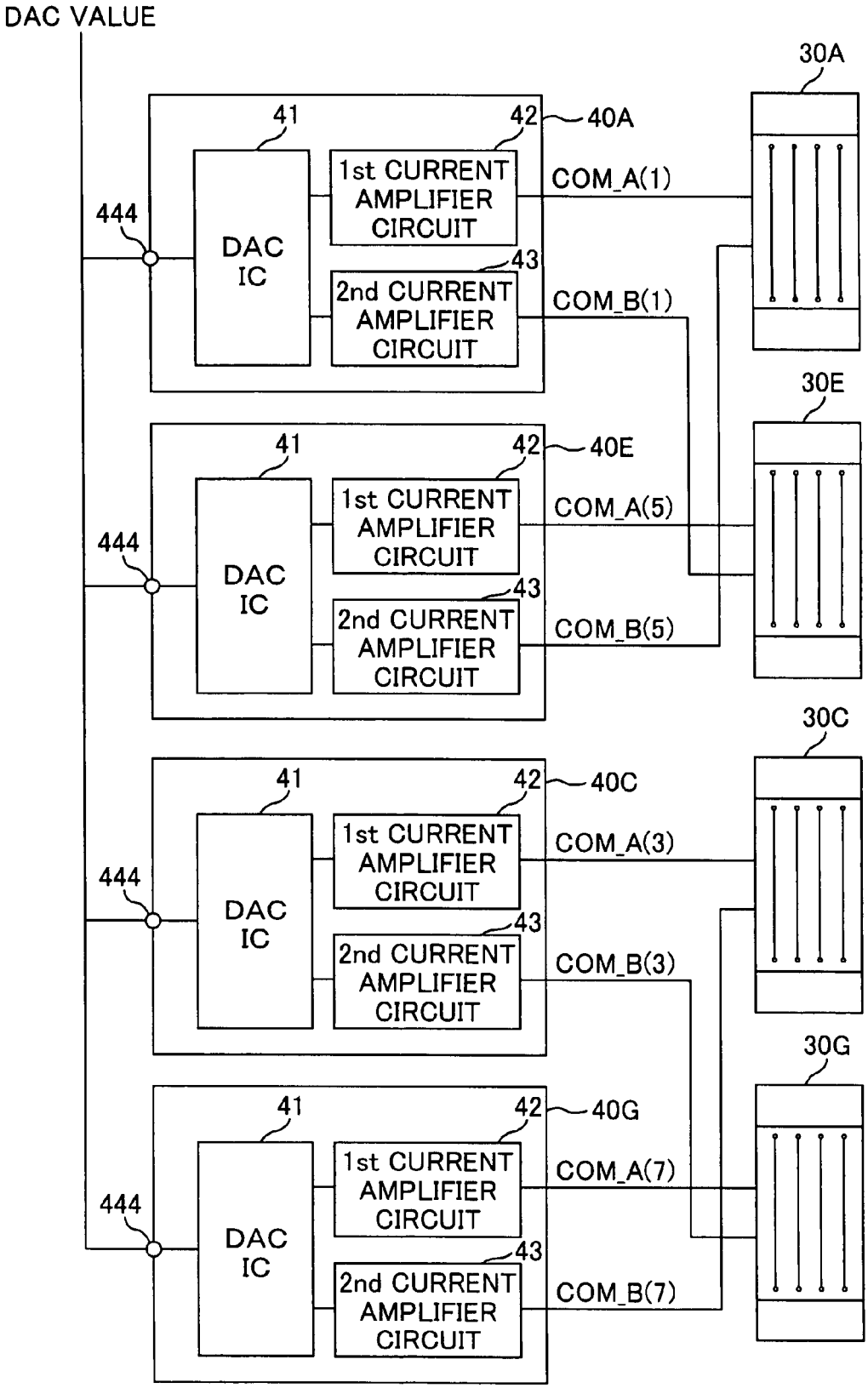
FIG. 9 is a diagram illustrating a schematic configuration of drive signal generation circuits, and supply of respective drive signals to an upstream side head unit group.
Figure 10B:
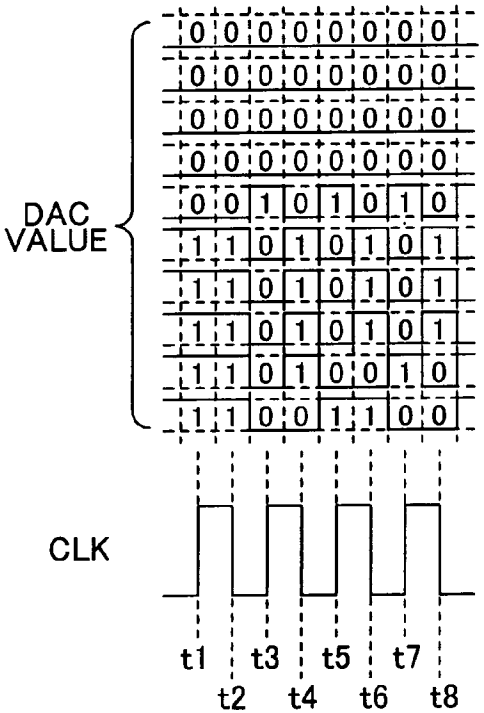
FIG. 10B is a diagram showing the timing for reading DAC values in the drive signal generation circuit.
Figure 10A:
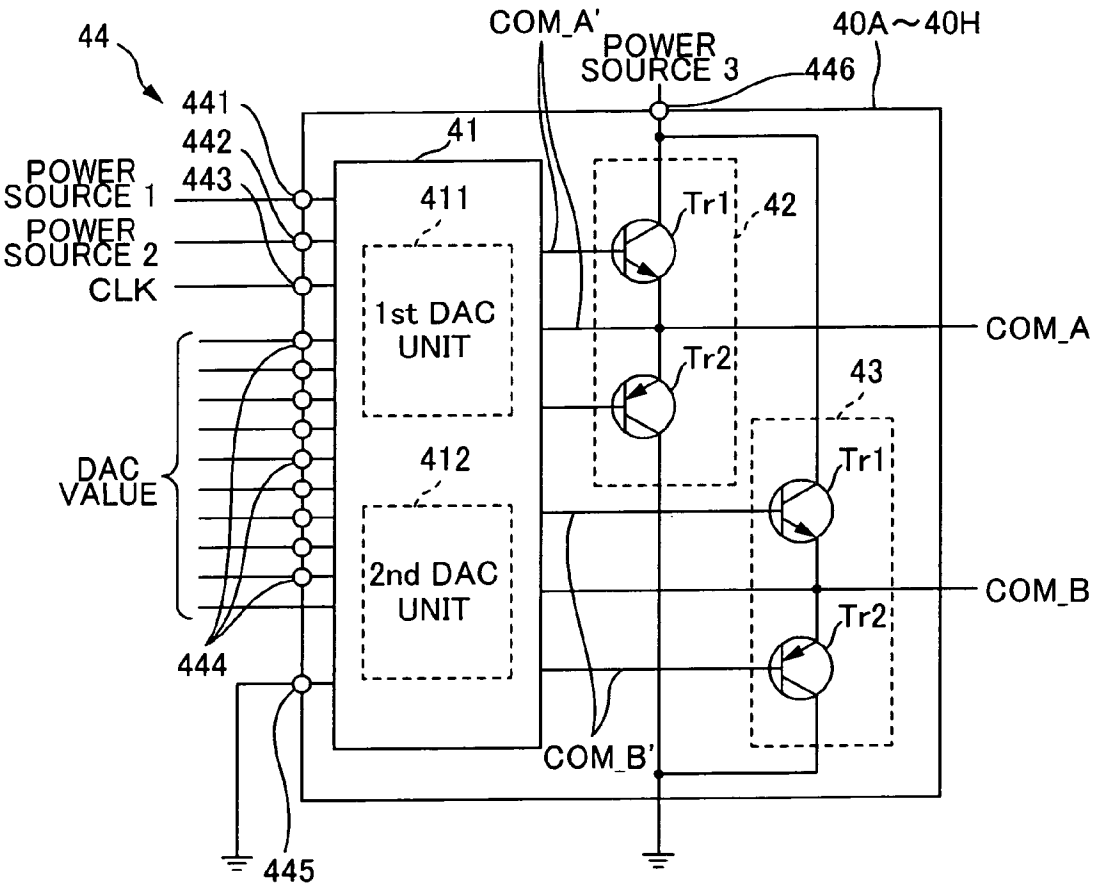
FIG. 10A is a diagram illustrating a configuration of the drive signal generation circuit.

Relation between Drive Signal Generation Circuits 40A to 40H and Head Units 30A to 30H Next, the relation between the drive signal generation circuits 40A to 40H and the head units 30A to 30H is described. For the purpose of convenience, four head units 30A, 30C, 30E and 30G constituting the downstream side head unit group are also referred to as a first head unit 30A, third head unit 30C, fifth head unit 30E, and seventh head unit 30G, respectively, in order from the left side in FIG. 3. Similarly, four head units 30B, 30D, 30F, and 30H constituting the upstream side head unit group are also referred to as a second head unit 30B, fourth head unit 30D, sixth head unit 30F, and eighth head unit 30H, respectively, in order from the left side in FIG. 3. Similarly, the drive signal generation circuits 40A to 40H of the drive signal generation section 40 are also referred to as a first drive signal generation circuit 40A to an eighth drive signal generation circuit 40H. These drive signal generation circuits 40A to 40H have the same configuration, and each of them generates the first drive signal COM_A and the second drive signal COM_B. As shown in FIGS. 9 and 10A, a single drive signal generation circuit includes a DAC_IC 41, a first current amplifier circuit 42, a second current amplifier circuit 43, and a terminal group 44.

The DAC_IC 41 obtains a DAC value (this corresponds to a voltage instruction) transmitted from the printer-side controller 10, and outputs a voltage signal for a voltage corresponding to the obtained DAC value. The DAC_IC 41 includes a first DAC unit 411 (this corresponds to a first voltage waveform signal generation section) that outputs a first voltage waveform signal COM_A' as a base of the first drive signal COM_A, and a second DAC unit 412 (this corresponds to a second voltage waveform signal generation section) that outputs a second voltage waveform signal COM_B' as a base of the second drive signal COM_B. DAC_IC 41 receives signals and the like via the terminal group 44. That is, the terminal group 44 includes a power source terminal 441 for the first DAC unit 411, a power source terminal 442 for the second DAC unit 412, a clock input terminal 443 to which a clock CLK is inputted (this corresponds to a timing signal input terminal), a DAC value input terminal 444 for inputting DAC values (this corresponds to a voltage instruction input terminal), and a ground terminal 445. The terminal group 44 further includes a power source terminal 446 for drive signals COM.

A first DAC value for the first drive signal COM_A (this corresponds to a first voltage instruction) and a second DAC value for the second drive signal COM_B (this corresponds to a second voltage instruction) are inputted to the DAC value input terminal 444. Specifically, the DAC value input terminal 444 functions as an input terminal for the first DAC value, while at the same time functioning as an input terminal for the second DAC value. In the printer 1, the printer-side controller 10 transmits to the DAC_IC 41 the first DAC value and the second DAC value alternately. The DAC_IC 41 uses the clock CLK as a timing signal, reads one of the first DAC value and the second DAC value at a rising edge timing of the clock CLK, and reads the other of the first DAC value and the second DAC value at a falling edge timing of the clock CLK. For example, as shown in FIG. 10B, DAC_IC 41 reads the first DAC values at rising edge timings indicated by timings t1, t3, t5, and t7. The read first DAC values are outputted to the first DAC unit 411 at their respective timings. Similarly, DAC_IC 41 reads the second DAC values at falling edge timings indicated by timings t2, t4, t6, and t8. The read second DAC values are outputted to the second DAC unit 412 at their respective timings.

In this manner, since the first DAC value and the second DAC value are inputted using a common input terminal (DAC value input terminal 444), it is possible to achieve simplification of a configuration. As a result, the number of wires can be reduced. In particular, the line head unit LU includes a plurality of head units 30A to 30H. Therefore, reducing wires allows more flexible wiring layout. Also, it is possible to suppress noise occurrence due to the reduced wire density.

In addition, in these drive signal generation circuits 40A to 40H, it is possible to define the voltage waveform of the first drive signal COM_A and the second drive signal COM_B by setting the first DAC value and the second DAC value. Therefore, it is possible to generate with good efficiency the first drive signal COM_A and the second drive signal COM_B having a complicated waveform.

The first current amplifier circuit 42 corresponds to the first current amplifier section. It amplifies the electric current of the first voltage waveform signal COM_A' and outputs the amplified signal as the first drive signal COM_A. The second current amplifier circuit 43 corresponds to the second current amplifier section. It amplifies the electric current of the second voltage waveform signal COM_B' and outputs the amplified signal as the second drive signal COM_B. These current amplifier circuits have the same configuration. In this embodiment, the first current amplifier circuit 42 is configured by a pair of transistors connected in a complimentary manner. Also, the second current amplifier circuit 43 is configured by another pair of transistors connected in a complimentary manner. Both of these pairs of transistors are configured by an NPN transistor Tr1 and a PNP transistor Tr2, whose respective emitter terminals are mutually connected.

As described above, since the current amplifier circuits 42 and 43 are configured by a pair of transistors, current amplification is possible with a simple configuration. The voltage waveform signals COM_A' and COM_B' subject to current amplification are applied respectively to the base of the NPN transistor Tr1 and the base of PNP transistor Tr2. The NPN transistor Tr1 operates when the voltage of an inputted voltage waveform signal rises, and the PNP transistor Tr2 operates when the voltage of the inputted voltage waveform signal falls. Here, each of the transistors Tr1 and Tr2 consumes power during charging/discharging with respect to the piezo element PZT. For example, during charging in which an electric current flows from the DAC_IC 41 to the piezo element PZT, the NPN transistor Tr1 consumes power. On the other hand, during discharging in which an electric current flows from the piezo element PZT to the DAC_IC 41, the PNP transistor Tr2 consumes power. Power consumption by the transistors Tr1 and Tr2 occupies a major portion in the entire power consumption in the DAC_IC 41.

Figure 8:
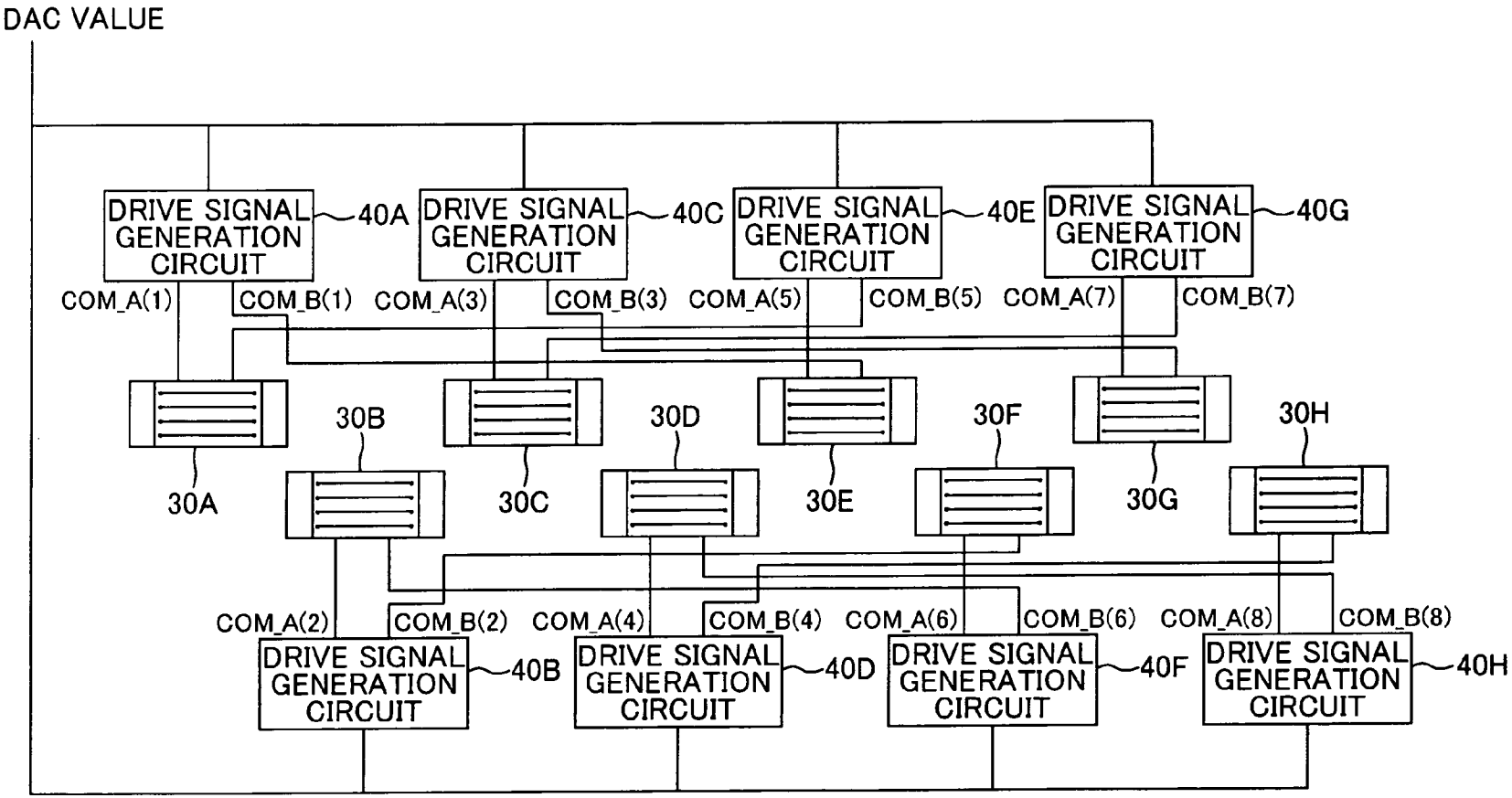
FIG. 8 is a block diagram for explaining relation of correspondence between drive signal generation sections and head units.

Next, the relation between the drive signals COM_A and COM_B generated by the drive signal generation circuits 40A to 40H and the head units 30A to 30H is described. In FIGS. 8 and 9, for the purpose of convenience, in order to identify each of the drive signals COM_A and the drive signals COM_B generated by the corresponding drive signal generation circuits 40A to 40H, each drive signal has the number indicating one of the drive signal generation circuits 40A to 40H that generated the drive signal suffixed in parentheses. For example, the drive signals COM_A and COM_B generated by the first drive signal generation circuit 40A have a suffix (1), and the drive signals COM_A and COM_B generated by the second drive signal generation circuit 40B have a suffix (2). Note that the drive signals COM_A and the drive signals COM_B generated by the corresponding drive signal generation circuits 40A to 40H are supplied to the corresponding head units 30A to 30H through wires.

The first drive signal generation circuit 40A generates the first drive signal COM_A(1) and the second drive signal COM_B(1). The first drive signal COM_A(1) is supplied to the first head unit 30A, and the second drive signal COM_B (1) is supplied to the fifth head unit 30E. The second drive signal generation circuit 40B generates the first drive signal COM_A(2) and the second drive signal COM_B(2). The first drive signal COM_A(2) is supplied to the second head unit 30B, and the second drive signal COM_B(2) is supplied to the sixth head unit 30F. The first drive signals COM_A and the second drive signals COM_B generated by other drive signal generation circuits 40C to 40H are respectively supplied to different head units. For example, the first drive signal COM_A(3) and second drive signal COM_B(3) generated by the third drive signal generation circuit 40C are supplied to the third head unit 30C and the seventh head unit 30G, respectively. The first drive signal COM_A(4) and second drive signal COM_B(4) generated by the fourth drive signal generation circuit 40D are supplied to the fourth head unit 30D and the eighth head unit 30H, respectively. Similarly, the first drive signal COM_A(5) and second drive signal COM_B(5) generated by the fifth drive signal generation circuit 40E are supplied to the fifth head unit 30E and the first head unit 30A, respectively. The first drive signal COM_A(6) and second drive signal COM_B(6) generated by the sixth drive signal generation circuit 40F are supplied to the sixth head unit 30F and the second head unit 30B, respectively. Further, the first drive signal COM_A(7) and second drive signal COM_B(7) generated by the seventh drive signal generation circuit 40G are supplied to the seven head unit 30G and the third head unit 30C, respectively. The first drive signal COM_A(8) and second drive signal COM_B(8) generated by the eighth drive signal generation circuit 40H are supplied to the eighth head unit 30H and the fourth head unit 30D, respectively.

Accordingly, when the first head unit 30A is selected as a head unit to eject ink, the first drive signal generation circuit 40A and the fifth drive signal generation circuit 40E generate the first drive signal COM_A(1) and the second drive signal COM_B(5), respectively, and supply them to the first head unit 30A. When the second head unit 30B is selected, the second drive signal generation circuit 40B and the sixth drive signal generation circuit 40F generate the first drive signal COM_A(2) and the second drive signal COM_B(6), respectively, and supply them to the second head unit 30B.

In this manner, in the printer 1, with respect to a certain head unit, the first drive signal COM_A and the second drive signal COM_B are supplied by different drive signal generation circuits. Therefore, when printing is performed on the paper S having a width shorter than a maximum printing width using some of the head units, supply of drive signals COM is shared by a plurality of drive signal generation circuits. That is, a plurality of drive signal generation circuits can be used with good efficiency. Burden on a single drive signal generation circuit can be reduced for reasons such as that the amount of an electric current passing through a single drive signal generation circuit can be reduced compared with the case in which a general configuration is employed.

Printing Operation

Regarding Printing Operation

Figure 11:
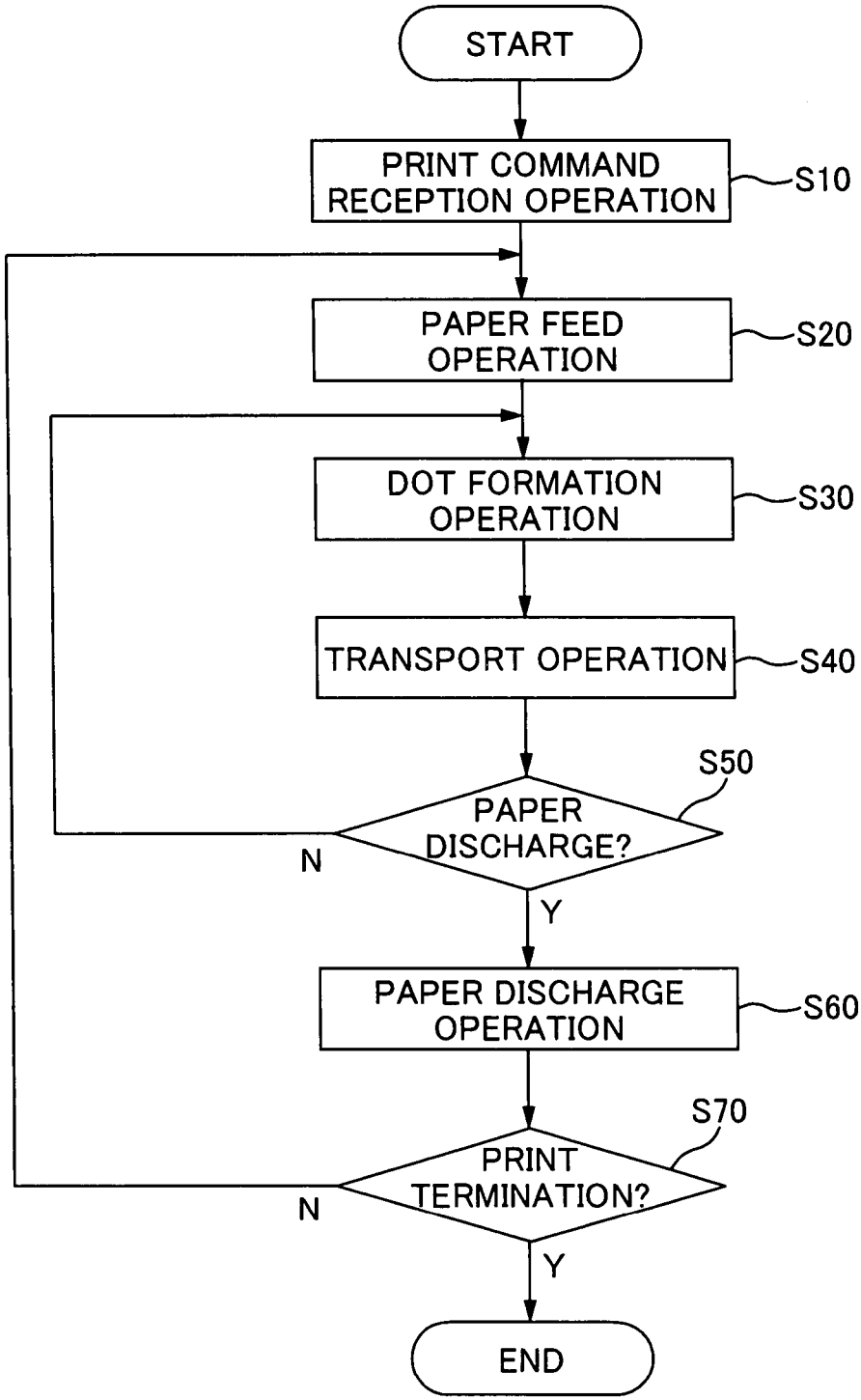
FIG. 11 is a flowchart illustrating a printing operation.

The printing operations that the printer 1 carries out to perform printing on the paper S are described next. As shown in FIG. 11, in the printer 1 a print command receipt operation (S10), a paper feed operation (S20), a dot formation operation (S30), a transport operation (S40), a paper discharge determination (S50), a paper discharge operation (S60), and a print termination determination (S70) are carried out as a sequence of printing operations. These printing operations are carried out by the CPU 12 of the printer-side controller 10 in accordance with computer programs stored in the memory 13. Therefore, the computer programs contain program code to carry out the operations.

The print command receipt operation is an operation of receiving a print command transmitted from the computer 110. This command is contained in the print data transmitted from the computer 110, for example. The paper feed operation is an operation of transporting the paper S to be printed on so as to be positioned at a print start position. The dot formation operation is an operation of causing ink to be intermittently ejected from a plurality of nozzles Nz provided in the head units 30A to 30H so as to form dots on the paper S. In the dot formation operation, the printer-side controller 10 outputs DAC values to the drive signal generation circuits so as to cause the drive signals COM to be generated. The printer-side controller 10 also transmits the dot formation data SI to cause the nozzles Nz provided in the heads to eject ink in synchronization with the transport of the paper S. Then, the ejected ink lands on unit regions on the paper S, and forms dots. Also, the formed dots constitute a raster line. The transport operation is an operation for transporting the paper S in a transport direction. Through this transport operation, the head unit group 30 can form dots at positions (unit region group) that are different from the positions of the dots formed in the preceding dot formation operation. The paper discharge determination is a process for determining whether or not to discharge the paper S being printed on. This determination is made based on the presence or absence of print data, for example. The print termination determination is to determine whether or not to continue printing.

Regarding Dot Formation Operation

In the printer 1, the head units 30A to 30H are fixed to the based frame BF. Therefore, the nozzles of the nozzle rows are also fixed at the predetermined positions. Accordingly, head units to eject ink are selected from among the head units 30A to 30H depending on the width of an image to be printed or the width of the paper S to be printed on. For example, in the case of so-called borderless printing in which printing is performed on the entire surface of the paper S, head units to eject ink are determined from among the head units 30A to 30H depending on the width of the paper S. The printer 1 prints images on the paper S by causing ink to be ejected from appropriate nozzles Nz, while transporting the paper S in the transport direction. Employing such a configuration shortens time required for printing.

As described above, the head units 30A to 30H carry out ink ejection with a first drive signal COM_A generated by a certain drive signal generation circuit and a second drive signal COM_B generated by another drive signal generation circuit. Therefore, when the width of an image to be printed (width of paper S) is a predetermined width or less, the drive signal generation circuits supply to the corresponding head units only one type of the drive signal COM. For example, a case in which borderless printing is performed on the paper S having a width indicated by the sign W1 in FIG. 3 is considered. In such a case, the width W1 is approximately half a maximum printing width. Therefore even in the case of borderless printing, it is sufficient that ink is ejected from four head units, the first head unit 30A to the fourth head unit 30D. Then, as shown in FIGS. 8 and 12, the first drive signal COM_A(1) and the second drive signal COM_B(5) are supplied to the first head unit 30A, and the first drive signal COM_A(2) and the second drive signal COM_B(6) are supplied to the second head unit 30B. The first drive signal COM_A(3) and second drive signal COM_B(7) are supplied to the third head unit 30C. The first drive signal COM_A(4) and second drive signal COM_B(8) are supplied to the fourth head unit 30D. In other words, the four drive signal generation circuits of the first drive signal generation circuit 40A to the fourth drive signal generation circuit 40D supply only the first drive signal COM_A, and the four drive signal generation circuits of the fifth drive signal generation circuit 40E to the eighth drive signal generation circuit 40H supply only the second drive signal COM_B. In this manner, by supplying the drive signals COM_A and COM_B using drive signal generation circuits 40A to 40H, the amount of an electric current passing through a single drive signal generation circuit can be suppressed, which as a result significantly suppresses power consumption. In this example, the drive signal generation circuits 40A to 40H are required only to pass an electric current in an amount that corresponds to one type of drive signal COM.

Also in the printer 1, a drive signal generation circuit that supplies the first drive signal COM_A to a certain head unit supplies the second drive signal COM_B to another head unit, and a drive signal generation circuit that supplies the second drive signal COM_B to a certain head unit supplies the first drive signal COM_A to another head unit. When printing is performed on wide-width paper S, the first drive signal COM_A and the second drive signal COM_B generated by a certain drive signal generation circuit are used. Therefore, it is possible to use the drive signals COM_A and the drive signals COM_B generated by the drive signal generation circuits 40A to 40H with good efficiency, when printing is performed on wide-width paper S having a width that exceeds half a maximum printing width.

For example, a case is examined in which borderless printing is performed on the paper S having a width shown with the sign W2 in FIG. 3. In such a case, since the width W2 is approximately three-fourths a maximum printing width, six head units including the first head unit 30A to the sixth head unit 30F eject ink. Then, as shown in FIGS. 8 and 13, the first drive signal COM_A(5) and the second drive signal COM_B (1) are supplied to the fifth head unit 30E, and the first drive signal COM_A(6) and the second drive signal COM_B(2) are supplied to the sixth head unit 30F. Drive signals supplied to the first head unit 30A to the fourth head unit 30D are as described above. Accordingly, the first drive signal generation circuit 40A supplies the first drive signal COM_A(1) to the first head unit 30A, and the second drive signal COM_B (1) to the fifth head unit 30E. Similarly, the second drive signal generation circuit 40B supplies the first drive signal COM_A(2) to the second head unit 30B, and the second drive signal COM_B(2) to the sixth head unit 30F. Furthermore, other drive signal generation circuits 40C to 40H respectively supplies one type of drive signal COM to the corresponding head units. Accordingly, when printing is performed on the paper S having the width W2, the number of the drive signal generation circuits that supply two types of drive signals COM, in other words, the number of the drive signal generation circuits that pass a large amount of electric current can be reduced to the minimum required number.

Summary

As understood from the above description, in the printer 1, a first drive signal COM_A generated by a certain drive signal generation circuit and a second drive signal COM_B generated by another drive signal generation circuit are supplied to a certain head unit. Therefore, a larger number of drive signal generation circuits can be effectively used. Also, a second drive signal COM_B generated by a certain drive signal generation circuit and a first drive signal COM_A generated by another drive signal generation circuit are supplied to another head unit. For this reason, as the printing width increases, the number of the drive signal generation circuits that supply two types of drive signals COM to corresponding head units in the head units 30A to 30H increases. Therefore, a plurality of drive signal generation circuits can be efficiently used.

The head units eject ink in accordance with the first drive signal COM_A and the second drive signal COM_B selectively applied to the piezo element PZT. Therefore, the amount of ejected ink can be varied by changing selection patterns of the first drive signal COM_A and the second drive signal COM_B.

Also, in this configuration, at least one head unit is disposed in the paper width direction, between a certain head unit that receives the first drive signal COM_A from a certain drive signal generation circuit and other head unit that receives the second drive signal COM_B from that certain drive signal generation circuit. For example, three head units 30B to 30D are disposed in the paper width direction between the first head unit 30A that receives the first drive signal COM_A(1) from the first drive signal generation circuit 40A and the fifth head unit 30E that receives the second drive signal COM_B(1) from the first drive signal generation circuit 40A. In such a configuration, the power consumption of the respective drive signal generation circuits 40A to 40H is determined depending on the width of the print image. Accordingly, when the printed image has a comparatively small width, it is possible to significantly suppress power consumption.

Furthermore, in this embodiment, division of a region is made in the paper width direction at the mid-point of a maximum printing width into one side and the other side. The first drive signal COM_A generated by a certain drive signal generation circuit is supplied to a head unit disposed on the one side in the paper width direction (for example, the first head unit 30A to the fourth head unit 30D), and the second drive signal COM_B generated by the same drive signal generation circuit is supplied to a head unit disposed on the other side in the paper width direction (for example, the fifth head unit 30E to the eighth head unit 30H). In this configuration, when printing on the paper S whose width is equal to or smaller than half a maximum printing width, the drive signal generation circuits 40A to 40H supply one type of drive signal COM to the corresponding head units. For this reason, the drive signal generation circuits 40A to 40H can be efficiently used.

Other Embodiments

In the foregoing embodiments, the printing system 100 having the printer 1 as a liquid ejection apparatus was mainly discussed. However, the foregoing description also includes the disclosure of printing methods, for example. In addition, the foregoing description includes disclosure of control devices for controlling printing heads, or computer programs or program code for controlling printing apparatuses and printing control devices. Moreover, this embodiment is for the purpose of elucidating the invention, and is not to be interpreted as limiting the invention. It goes without saying that the invention can be altered and improved without departing from the gist thereof and includes functional equivalents. In particular, embodiments described below are also included in the invention.

Relation between Drive Signal Generation Circuit and Head Unit

In the foregoing embodiments, as shown in FIG. 9, two drive signal generation circuits and two head units formed one group. However, the combination of the drive signal generation circuits and head units is not limited to this. For example, three or more drive signal generation circuits and head units may be combined to form one group.

Furthermore, in the foregoing embodiments, the number of the drive signal generation circuits (indicated as "N"), and the number of the head units (indicated as "M") were equal. However, there is no limitation to this configuration. For example, the number N of the drive signal generation circuits may be smaller than the number M of the head units. In such a case, it is preferable that N=M/n (n is a positive integer of 2 or more). With such a configuration, by supplying drive signals COM generated by a single drive signal generation circuit respectively to n head units, supply to the head units 30A to 30H of the drive signals COM can be evenly assigned to the drive signal generation circuits (each drive signal generation circuit supplies the same number of drive signals).

Types of Drive Signals Generated by Drive Signal Generation Circuit

In the foregoing embodiments, it was a configuration in which a single drive signal generation circuit generated two types of drive signals, COM_A and COM_B. The number of types of the generated drive signals is not limited to two, as long as it is two or more. For example, three types, four or more types of drive signals may be generated.

Element that Operates for Ink Ejection

In the foregoing embodiments, a piezo element PZT was described as an example of an element that operates for ink ejection. However, this is not limited to the piezo element PZT. Any element can be used as long as it operates in accordance with the drive signals COM. For example, an electrostatic actuator, a magnetostrictive element, or a heater element may be used.

Other Exemplary Applications

The foregoing embodiments describe the printer 1 as a printing apparatus, but this is not a limitation. For example, technology similar to that of the present embodiments can also be adopted for various types of apparatuses that use inkjet technology, including color filter manufacturing devices, dyeing devices, fine processing devices, semiconductor manufacturing devices, surface processing devices, three-dimensional shape forming machines, liquid vaporizing devices, organic EL manufacturing devices (particularly high molecular weight EL manufacturing devices), display manufacturing devices, film formation devices, and DNA chip manufacturing devices. Moreover, methods and manufacturing methods of these are also within the scope of application.

What is claimed is:

1. A liquid ejection method comprising:

causing a certain drive signal generation unit to generate a first drive signal and a second drive signal;

causing another drive signal generation unit to generate a first drive signal and a second drive signal;

supplying the first drive signal generated by the certain drive signal generation unit and the second drive signal generated by the other drive signal generation unit to a certain head unit, the certain head unit being one of a plurality of head units arranged in an intersecting direction that intersects a transport direction of a medium; and ejecting liquid from the certain head unit in accordance with the first drive signal and the second drive signal.

2. A liquid ejection method according to claim 1, wherein the second drive signal generated by the certain drive signal generation unit and the first drive signal generated by the other drive signal generation unit are supplied to another head unit.

3. A liquid ejection method according to claim 2, wherein the other head unit is disposed shifted in the intersecting direction with respect to the certain head unit, with at least one head unit sandwiched between the other head unit and the certain head unit.

4. A liquid ejection method according to claim 1, wherein the head unit includes an element that operates to eject liquid, and causes liquid to be ejected in accordance with the first drive signal and the second drive signal selectively applied to the element.

5. A liquid ejection method according to claim 4, wherein the head unit includes a first switch for controlling application of the first drive signal to the element, and a second switch for controlling application of the second drive signal to the element, and controls the first switch and the second switch depending on an instructed tone value that defines an ejection amount of liquid so as to selectively apply to the element a necessary portion of the first drive signal and a necessary portion of the second drive signal.

6. A liquid ejection method according to claim 1, wherein the drive signal generation unit includes, a first voltage waveform signal generation section that generates a first voltage waveform signal based on a first voltage instruction for defining a voltage waveform of the first drive signal, a second voltage waveform signal generation section that generates a second voltage waveform signal based on a second voltage instruction for defining a voltage waveform of the second drive signal, a first current amplifier section that generates the first drive signal by performing current amplification on the first voltage waveform signal, and a second current amplifier section that generates the second drive signal by performing current amplification on the second voltage waveform signal.

7. A liquid ejection method according to claim 6, wherein the first current amplifier section includes a pair of transistors connected in a complimentary manner, and the second current amplifier circuit includes another pair of transistors connected in a complimentary manner.

8. A liquid ejection method according to claim 6, wherein the drive signal generation unit includes, a voltage instruction input terminal that receives the first voltage instruction and the second liquid ejection instruction, and a timing signal input terminal that receives a timing signal for defining a timing to acquire the first voltage instruction and the second liquid ejection instruction, and the drive signal generation unit acquires one of the first voltage instruction and the second liquid ejection instruction at a rising edge timing of the voltage of the timing signal, and acquires the other of the first voltage instruction and the second liquid ejection instruction at a falling edge timing of the voltage of the timing signal.

9. A liquid ejection method according to claim 1, wherein the plurality of head units include:

a first head unit group that has a plurality of the head units arranged in the intersecting direction at a predetermined interval, and arranged in a certain position in the transport direction, and a second head unit group that has a plurality of the head units arranged in the intersecting direction at the predetermined interval, and arranged in another position in the transport direction.

10. A liquid ejection method according to claim 9, wherein the plurality of head units of the second head unit group are arranged shifted in the intersecting direction with respect to the plurality of head units of the first head unit group.

11. A liquid ejection apparatus comprising:

a transport mechanism that transports a medium in a transport direction;

a line head unit in which a plurality of head units that eject liquid in accordance with a first drive signal and a second drive signal are arranged in an intersecting direction that intersects the transport direction; and a drive signal generation section, including a plurality of drive signal generation units that generate the first drive signal and the second drive signal, which supplies a first drive signal generated by a certain drive signal generation unit and a second drive signal generated by another drive signal generation unit to a certain head unit.

* * * * *